US007182298B2

(12) United States Patent
Fischer

(10) Patent No.: US 7,182,298 B2
(45) Date of Patent: Feb. 27, 2007

(54) TRACK-GUIDED TRANSPORT SYSTEM AND METHOD FOR CONTROLLING CARS OF A TRACK-GUIDED TRANSPORT SYSTEM

(75) Inventor: Werner Fischer, Mörfelden-Walldorf (DE)

(73) Assignee: Duerr Systems GmbH, Stuttgart (DE)

( * ) Notice: Subject to any disclaimer, the term of this patent is extended or adjusted under 35 U.S.C. 154(b) by 0 days.

(21) Appl. No.: 11/489,165

(22) Filed: Jul. 19, 2006

(65) Prior Publication Data

US 2006/0255210 A1 Nov. 16, 2006

Related U.S. Application Data

(63) Continuation of application No. 11/113,496, filed on Apr. 25, 2005, now abandoned, which is a continuation of application No. PCT/EP03/11243, filed on Oct. 10, 2003.

(30) Foreign Application Priority Data

Oct. 30, 2002 (DE) ..... 102 50 545

(51) Int. Cl.
*B61L 3/00* (2006.01)

(52) U.S. Cl. ..... 246/167 R; 246/182 R; 701/19

(58) Field of Classification Search ..... 246/167 R, 246/185, 182 C, 122 R, 62, 167 D, 1 C, 246/3, 4, 6, 2 S, 182 R; 104/88.02, 88.03, 104/88.04, 124, 118; 105/141; 701/19, 701/20

See application file for complete search history.

(56) References Cited

U.S. PATENT DOCUMENTS

| | | | | |
|---|---|---|---|---|
| 3,854,408 | A | 12/1974 | Miller | |
| 4,735,383 | A * | 4/1988 | Corrie | 246/3 |
| 4,864,306 | A | 9/1989 | Wiita | |
| 5,533,695 | A * | 7/1996 | Heggestad et al. | 246/62 |
| 5,777,451 | A | 7/1998 | Kobayashi et al. | |
| 5,924,653 | A | 7/1999 | Pedersen et al. | |
| 5,950,966 | A * | 9/1999 | Hungate et al. | 246/62 |
| 6,135,396 | A * | 10/2000 | Whitfield et al. | 246/182 R |

(Continued)

FOREIGN PATENT DOCUMENTS

DE 197 12 107 A1 9/1998

(Continued)

*Primary Examiner*—Mark T. Le
(74) *Attorney, Agent, or Firm*—Leydig, Voit & Mayer, Ltd.

(57) ABSTRACT

In order to provide a track-guided transport system, and in particular a suspended monorail system, comprising a track network incorporating at least one node at which at least two track sections of the track network adjoin one another and also comprising a plurality of vehicles travelling along the track network and each of which comprises a control unit wherein the control of the movements of these vehicles can be effected in a simple and reliable manner even when there are a large number of vehicles, it is proposed that at least one successor or the information that the vehicle does not have a successor and/or at least one forerunner or the information that the vehicle does not have a forerunner be associated with each vehicle, wherein the information relating to the successor or the forerunner is stored in the control unit of the vehicle and is updated when the vehicle passes a node of the track network.

16 Claims, 7 Drawing Sheets

U.S. PATENT DOCUMENTS

| | | | | |
|---|---|---|---|---|
| 6,666,411 | B1 | 12/2003 | Hart et al. | |
| 6,679,459 | B2 | 1/2004 | Kaiser | |
| 6,810,817 | B1 * | 11/2004 | James | 104/88.04 |
| 2005/0247231 | A1 | 11/2005 | Fischer | |
| 2006/0195236 | A1 * | 8/2006 | Katsuta et al. | 701/19 |

FOREIGN PATENT DOCUMENTS

| | | | |
|---|---|---|---|
| DE | 198 28 878 | A1 | 12/1999 |
| DE | 100 39 946 | C1 | 4/2002 |
| EP | 0 748 080 | A1 | 12/1996 |

* cited by examiner

V0
V1
V2
V3
V4
V5
V6
P1
P2
160
162
164
166
168
170
172
174
176

V1
168
202
192
204
162
BP
206
V2
164
CP
V3
V4
BP
CP
162
166
170
162

168
210
192
V1
208
212
BP
162
164
V2
CP
V3
V4
BP
CP
166
162
170
162

192
216
V1
168
BP
218
162
214
164
CP
V4
V3
V2
BP
CP
162
166
170
162

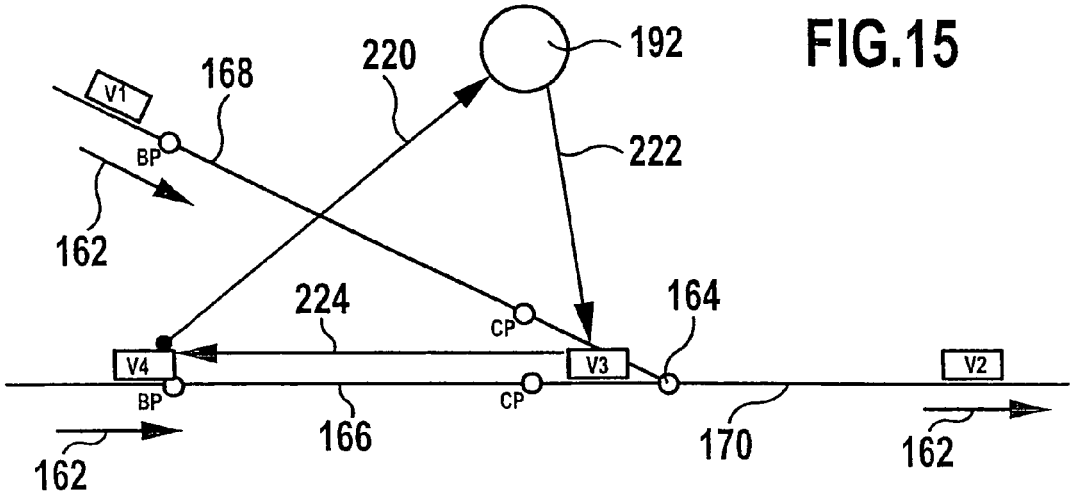
FIG.15
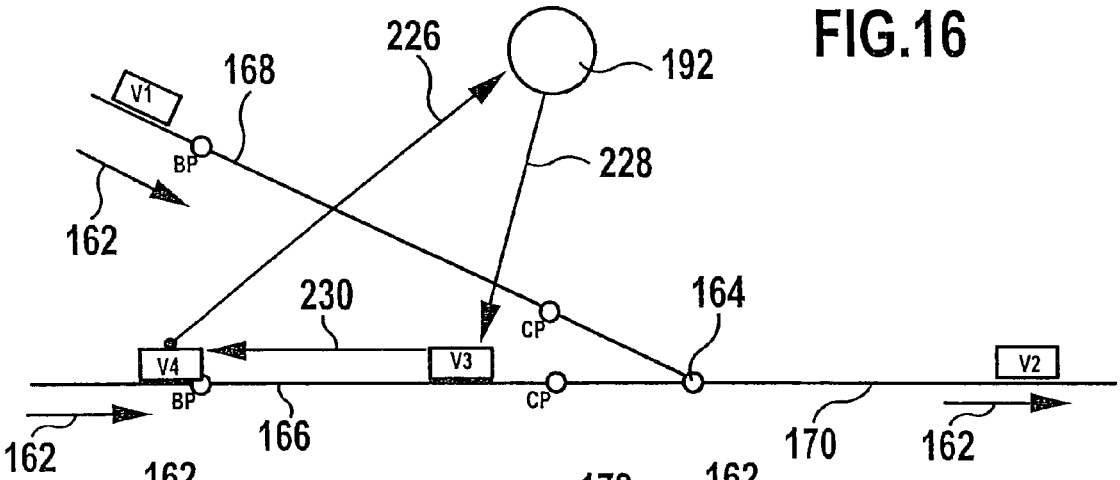
FIG.16
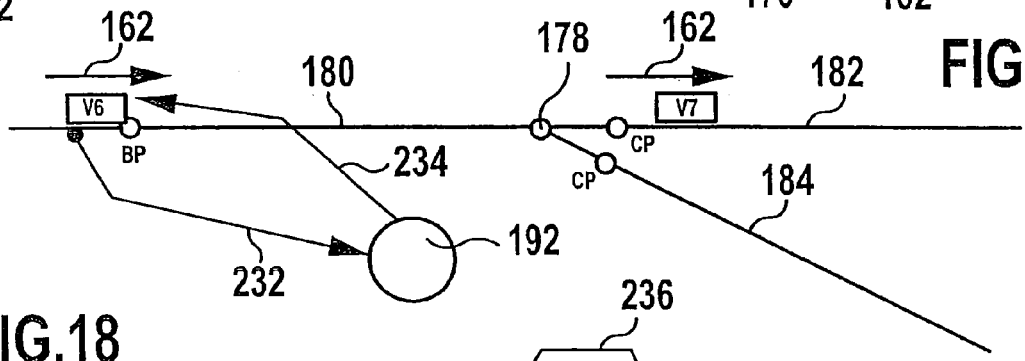
FIG.17
FIG.18
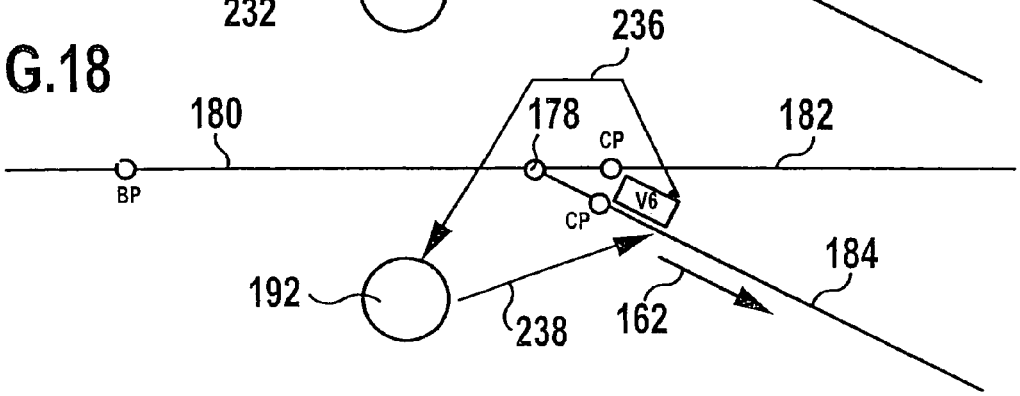

TRACK-GUIDED TRANSPORT SYSTEM AND METHOD FOR CONTROLLING CARS OF A TRACK-GUIDED TRANSPORT SYSTEM

CROSS-REFERENCE TO RELATED APPLICATIONS

This application is a continuation of prior application Ser. No. 11/113,496, filed on Apr. 25, 2005, now abandoned which is the National Phase of International Application No. PCT/EP2003/011243, filed Oct. 10, 2003, and which claims priority to German Patent Application No. 102 50 545.4, filed Oct. 30, 2002, all of which are hereby incorporated by reference in their entirety.

FIELD OF THE DISCLOSURE

The present invention relates to a track-guided transport system, and in particular a suspended monorail system, which comprises a track network incorporating at least one node at which at least two track sections of the track network adjoin one another and also comprises a plurality of vehicles travelling along the track network and which each comprise a control unit.

Furthermore, the present invention relates to a method of controlling the vehicles in such a track-guided transport system.

BACKGROUND

Such a track-guided transport system is known from DE 195 12 107 A1 for example.

If the track-guided transport system comprises a large number of vehicles which are travelling through the track network at the same time, then a system for controlling all these vehicles by means of a central control unit for the transport system necessitates a large amount of computing power in the central control unit and a very extensive exchange of data between the vehicles and the central control unit.

SUMMARY OF THE INVENTION

Consequently, the object of the present invention is to provide a track-guided transport system of the type mentioned hereinabove which will enable the control of the movements of these vehicles to be effected in a simple and reliable manner even when there are a large number of vehicles.

In accordance with the invention, this object is achieved in the case of a track-guided transport system comprising the features discloses in that at least one successor or the information that the vehicle does not have a successor, and/or at least one forerunner or the information that the vehicle does not have a forerunner is associated with each vehicle, wherein the information relating to the successor or the forerunner is stored in the control unit of the vehicle and is updated when the vehicle passes a node of the track network.

Herein, a "successor" is to be understood as being another vehicle whose current position—as seen in the direction of travel of the vehicle concerned—is located behind the vehicle concerned. This successor could also be located on a track section other than that of the vehicle concerned.

In corresponding manner, a "forerunner" is to be understood as being another vehicle whose current position—as seen in the direction of travel of the vehicle concerned—is located in front of the vehicle concerned. Such a forerunner could also be located on a track section other than that of the vehicle concerned.

Since, in accordance with the solution according to the invention and at any arbitrary time point, each of the vehicles knows its successor and its forerunner (or knows that it does not have a successor or a forerunner to whom it would have to pay attention), the data traffic which is needed for controlling the movement of the vehicles and which is exchanged between the vehicles on the one hand and a central control unit of the track-guided transport system on the other can be significantly reduced. It is even possible for the movement of the vehicles to be controlled exclusively by a process of communication between the vehicles themselves without there being any need at all for a central control unit for performing this task.

Thus, in particular, the regulation of the mutual spacing between vehicles travelling along a section of track one behind the other can be accomplished without the intermediary of a central control unit, for example, in that each vehicle continually passes its current position on to its successor, the successor continually determines the distance between the two vehicles from the position of the forerunner and its own position and, if necessary, takes the appropriate steps (decelerating or accelerating) that are required for regulating their mutual spacing to a given desired value.

Since the track network of the track-guided transport system also contains nodal points whereat the successor and forerunner relationships between the vehicles may change, the information relating to the successor or the forerunner of each vehicle is updated when the vehicle passes a node of the track network.

Such a node of the track network can, for example, be in the form of a branching point at which one track branches out into a plurality of onwardly extending tracks.

Furthermore, such a node of the track network can be in the form of a junction point at which a plurality of tracks combine into one onwardly extending track.

In a special embodiment of the transport system in accordance with the invention provision is made for the information relating to the successor or the forerunner of a vehicle to be updated by a process of communication with at least one other vehicle of the transport system.

Alternatively or in addition thereto, provision may be made for the information relating to the successor or the forerunner of a vehicle to be updated by a process of communication with a node administration unit arranged outside the vehicle.

In particular, such a node administration unit may comprise a programmable computer and the appertaining node administration software.

Provision may also be made for the node administration unit to comprise a plurality of node administration software modules which run on different computers. These computers could also be spatially separate from one another.

In particular, at least one of these computers can be fixed. As an alternative or in addition thereto, provision may also be made for at least one of these computers to be arranged in one of the vehicles in the transport system.

In a preferred embodiment of the transport system, provision is made for at least one node administration unit to be fixed.

As an alternative or in addition thereto, provision may also be made for at least one node administration unit to be arranged in a central control unit of the transport system.

In order to reduce the number of node administration units required, provision may also be made for at least one node administration unit to administer a plurality of nodes of the track network.

As an alternative thereto, provision may also be made for a separate node administration unit to be associated with each node of the track network.

The updating of the information relating to the successor or the forerunner can, for example, be achieved in that, after passing a brake point which is associated with a node, a vehicle sends a message which is effective to update the information relating to a successor and/or a forerunner of the vehicle concerned.

Herein, a "brake point" is to be understood as being a point of a track section that is at a predetermined distance from the node which may be a junction point or a branching point, said distance being determined—in dependence on the speed of the vehicle concerned—in such a way that the vehicle can still be brought to a stop in good time before reaching the node in order to prevent a collision with another vehicle passing through the node.

The message sent by the vehicle when passing the brake point can be addressed to another vehicle or to a node administration unit of the transport system.

Furthermore, after passing a brake point which is associated with a node, provision may be made for a vehicle to send a message which is effective to update the information relating to a successor and/or a forerunner of at least one other vehicle.

A particularly high level of operational reliability is obtained if, after passing a brake point which is associated with a node, provision is made for a vehicle to send a message which is effective to update the information relating to a successor and/or a forerunner of at least one vehicle, and subsequently to receive an acknowledging message which was triggered directly or indirectly by the sending of said first-mentioned message. In this way, the vehicle which triggered the updating process receives a confirmation of the fact that its message for enabling the updating process has reached the receiver and that the updating process has been successfully concluded.

The acknowledging message can be sent by the receiver of the message for enabling the updating process or by another transmitter which was included in the updating process by the receiver of the message for enabling the updating process.

Furthermore, in a preferred embodiment of the invention, provision is made for a vehicle to send a message after passing a collision point which is associated with a node, which message is effective to update the information relating to a successor and/or a forerunner of the vehicle concerned.

Herein, a "collision point" is to be understood as being a point of a track section which is at such a distance from the appertaining node that a vehicle, which is on the side of the collision point remote from the node, is at a distance from the node which is such as to exclude the possibility of a collision with another vehicle that is passing through the same node on other track sections.

If the node is a junction point, then the collision point lies in front of the node in the direction of travel.

If the node is a branching point, then the collision point lies beyond the node as seen in the direction of travel.

The determination of a collision point is usually effected—other than is the case for the determination of the brake point—independently of the actual speed of the vehicle.

The message triggering the updating process can be sent to another vehicle or to a node administration unit.

Furthermore, provision may be made for a vehicle to send a message after passing a collision point that is associated with a node, which message is effective to update the information relating to a successor and/or a forerunner of at least one other vehicle.

The operational reliability of the transport system in accordance with the invention is increased still further if provision is made for a vehicle to send a message after passing a collision point that is associated with a node, which message is effective to update the information relating to a successor and/or a forerunner of at least one vehicle, and subsequently to receive an acknowledging message which was triggered directly or indirectly by the sending of said first-mentioned message. In this way, the vehicle which triggered the updating process receives a confirmation of the fact that its message for enabling the updating process has reached the receiver and that the entire updating process has been successfully concluded.

In the case where the acknowledging message is missing, suitable measures can be adopted, for example, emergency stoppage of the vehicles.

A further object of the invention is to provide a method of controlling the vehicles of a track-guided transport system of the type mentioned hereinabove which is such as to enable the process of controlling the movement of the vehicles to be effected in a simple and reliable manner even when there are a large number of vehicles.

In accordance with the invention, this object is achieved in the case of a method comprising the features disclosed in that at least one successor or the information that the vehicle does not have a successor, and/or at least one forerunner or the information that the vehicle does not have a forerunner is associated with each vehicle, wherein the information relating to the successor or the forerunner is stored in the control unit of the vehicle and is updated when the vehicle passes a node of the track network.

Special embodiments of the method in accordance with the invention form the subject matter are also disclosed herein, their advantages having already been explained in connection with the special embodiments of the transport system in accordance with the invention.

Further features and advantages of the invention form the subject matter of the following description and the graphic illustration of exemplary embodiments.

BRIEF DESCRIPTION OF THE DRAWINGS

FIGS. 14 and 15 a schematic illustration of the communication process between vehicles and a node administration unit and between themselves when passing a collision point and a brake point which are associated with a junction point;

FIG. 16 a schematic illustration of the communication process between vehicles and a node administration unit and between themselves in a situation that is modified with respect to the situation shown in FIG. 15;

FIGS. 17 and 18 a schematic illustration of the communication process between a vehicle and a node administration unit when passing a brake point and a collision point relating to a branching point;

The same or functionally equivalent elements are designated by the same reference symbols in each of the Figures.

DETAILED DESCRIPTION OF THE INVENTION

Figure 2:
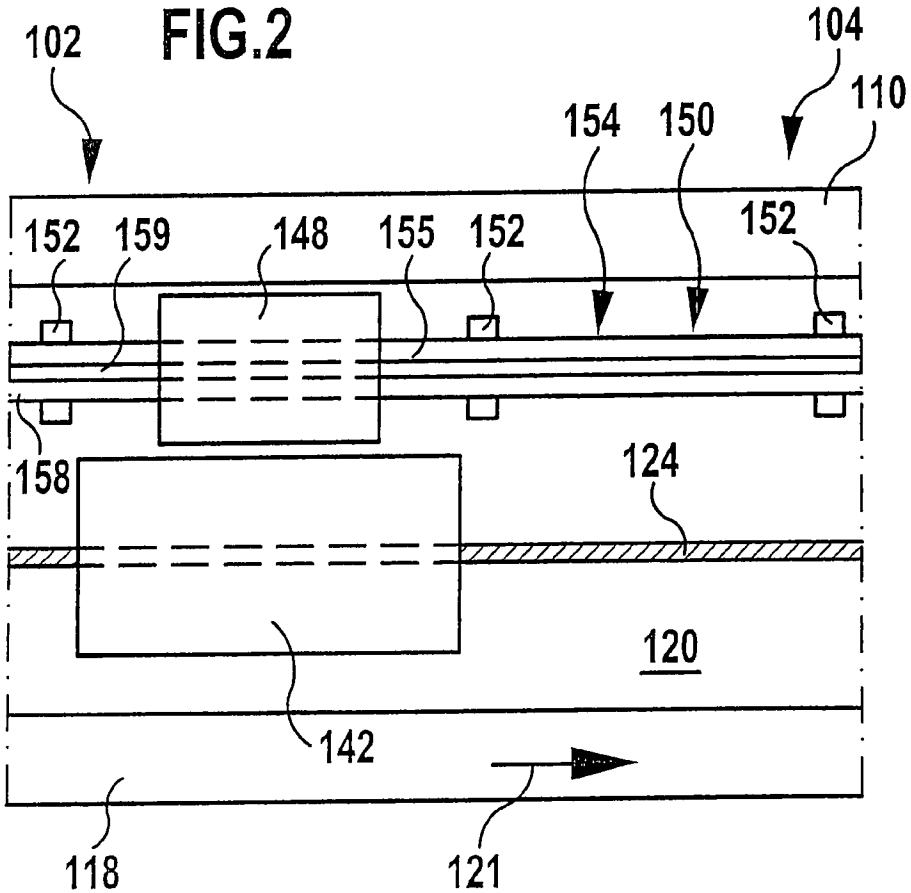
FIG. 2 a schematic side view of the running rail depicted in FIG. 1 in the case where a vehicle of the suspended monorail system is present.
Figure 1:
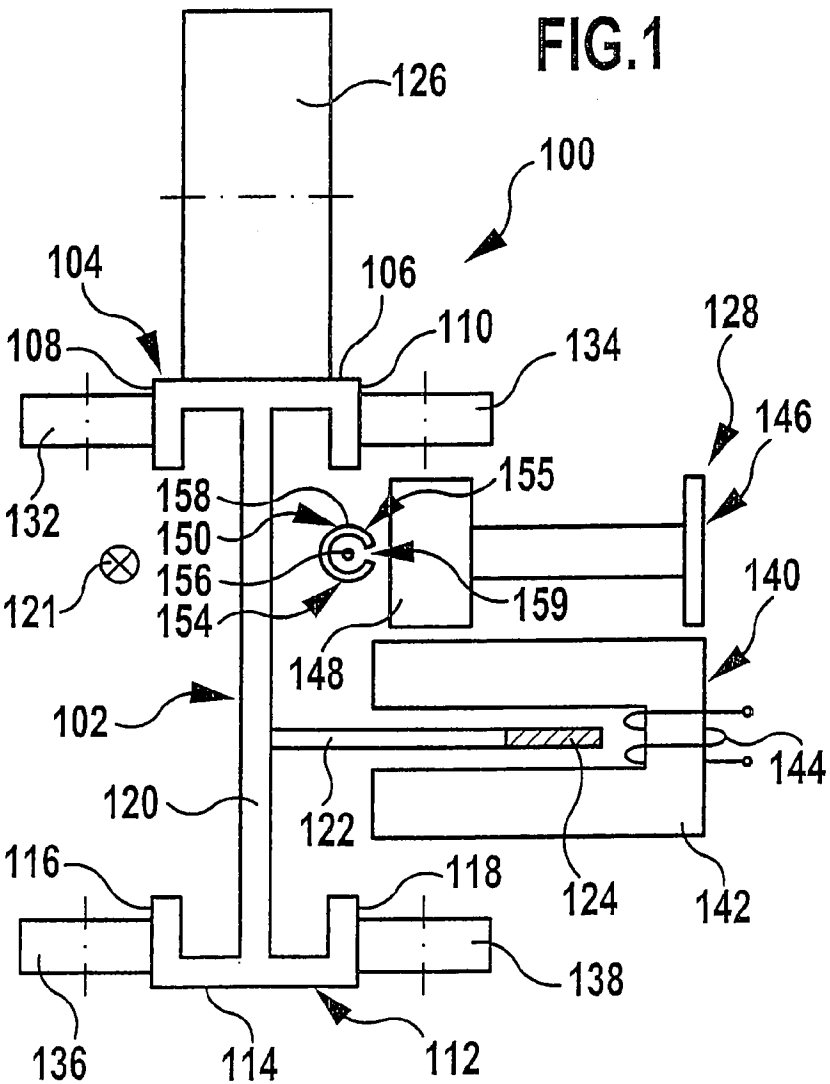
FIG. 1 a schematic cross section through a running rail of a suspended monorail system including a schematic illustration of the supporting and guide rollers as well as an energy transmission unit and a data transmission unit of a vehicle of the suspended monorail system.

A transport system in the form of a suspended monorail system in the exemplary embodiment and bearing the general reference 100 comprises a running rail 102 which is illustrated in the form of a cross section in FIG. 1 and as a side view in FIG. 2 and comprises an upper flange 104 having an upper, essentially flat bearing surface 106 and two lateral guidance surfaces 108 and 110 as well as a lower flange 112 having a lower flat bearing surface 114 and two lateral guidance surfaces 116 and 118.

At the sides thereof opposite the bearing surfaces, the two flanges are connected by a vertical web 120 whose walls are flat and extend in parallel with the longitudinal direction 121 of the rail.

A current supply line carrier 122 formed from an electrically insulating material projects out from a side wall of the web 120 between the two flanges 104 and 112 and supports a current supply line 124 on the end thereof remote from the web 120.

A supporting roller 126 of a vehicle 128 of the suspended monorail system 100 rolls on the upper bearing surface 106 of the running rail 102.

Apart from the supporting roller 126, only the lateral guide rollers 132, 134, 136 and 138 which roll on the respective lateral guidance surfaces 108, 110, 116 and 118 and an energy transmission unit 140 and a data transmission unit 146 of this vehicle 128 are illustrated in the Figures.

The energy transmission unit 140 comprises, for example, a current collector 142 which is in the form of a U-shaped ferrite core and has arranged thereon a coiled conductor 144 which is connected to a (not illustrated) current collecting electronic circuit for converting an alternating current that is induced in the coiled conductor into a DC voltage.

The current supply line 124 dips into the U-shaped current collector 142 of the energy transmission unit 140 but does not touch it.

The transfer of energy from the current supply line 124 to the energy transmission unit 140 is effected by an induction process. To this end, a medium frequency alternating current, which produces a corresponding time-varying magnetic flux in the current collector 142, is fed into the current supply line 124 and the running rail 102 serving as a return conductor so that an alternating current can be induced in the coiled conductor 144 and be converted into a DC voltage in the vehicle 128 for operational and control purposes.

The vehicle 128 is supported on the running rail 102 by means of a plurality of supporting rollers 126 and is guided on the lateral guidance surfaces of the running rail 102 by means of the guide rollers 132, 134, 136 and 138.

Furthermore, the vehicle 128 is adapted to be driven by a (not illustrated) drive unit which may be in the form of a friction wheel drive for example.

The data transmission unit 146 of the vehicle 128 comprises a near field coupler 148 which is held on the vehicle 128 above the energy transmission unit 140 and is designed for bi-directional communication with a data transmission line 150 which extends along the running rail 102 and is held by means of mounting plates 152 (see FIG. 2) on the side wall of the web 120 of the rail 102 facing the near field coupler 148.

The data transmission line 150 is in the form of a coaxial cable 155 having a central copper conductor 156 and a sheath 158 surrounding the same, whereby, on the side thereof facing the near field coupler 148 of the vehicle 128, the sheath 158 incorporates an axial slot 159 which extends in the longitudinal direction of the coaxial cable 155 and through which high frequency waves can exit from the coaxial cable 155 or enter into the coaxial cable 155.

The coaxial cable 155 slit in the longitudinal direction thereof thus forms a leaky wave guide 154.

The leaky wave guide 154 is fed with high frequency signals by a (not illustrated) fixed central control unit of the transport system 100, by fixed decentralized node administration computers and/or by other vehicles, said signals propagating along the leaky wave guide 154 and being received by the near field coupler 148 of the vehicle 128. A (not illustrated) evaluating circuit in the vehicle 128 demodulates these high frequency signals and converts them into data that is usable by the control unit of the vehicle 128.

Conversely, data produced in the control unit of the vehicle 128 is modulated onto a high-frequency carrier signal by a modulating circuit and fed via the near field coupler 148 into the leaky wave guide 154 wherein these signals propagate to another vehicle or to fixed (centralized or decentralized) control stations of the transport system 100.

The information relating to at least one successor of the vehicle concerned is stored in the control unit of each vehicle 128 (which unit comprises a freely programmable processor and a memory). Herein, a "successor" is to be understood as being another vehicle whose current position—as seen in the direction of movement of the vehicle concerned—is located behind the vehicle concerned. The successor can be on a section of track other than that of the vehicle concerned. If, at a certain point in time, no successor is associated with the vehicle 128 concerned, then the information that the vehicle does not have a successor is stored in its control unit.

Furthermore, the information relating to at least one forerunner of the vehicle concerned is stored in the control unit of each vehicle 128. Herein, a "forerunner" is to be understood as being another vehicle whose current position—as seen in the direction of movement of the vehicle concerned—is located in front of the vehicle concerned. The forerunner can be on a section of track other than that of the vehicle concerned. If, at a certain point in time, no forerunner is associated with the vehicle concerned, then the information that the vehicle does not have a forerunner is stored in its control unit.

The fact that, at any arbitrary time point, each of the vehicles 128 knows about its successor and its forerunner (or knows that it does not have a successor or a forerunner), makes it possible for the movement of the vehicles to be controlled exclusively by a process of communication between the vehicles themselves without the need to enlist a central control unit for this purpose.

Thus, in particular, the regulation of the mutual spacing between vehicles travelling one behind the other on a section of track can be accomplished without the intervention of a central control unit. This will be explained in more detail hereinafter with reference to FIGS. 3 to 5.

Figures 3, 4, 5, 6, 7:
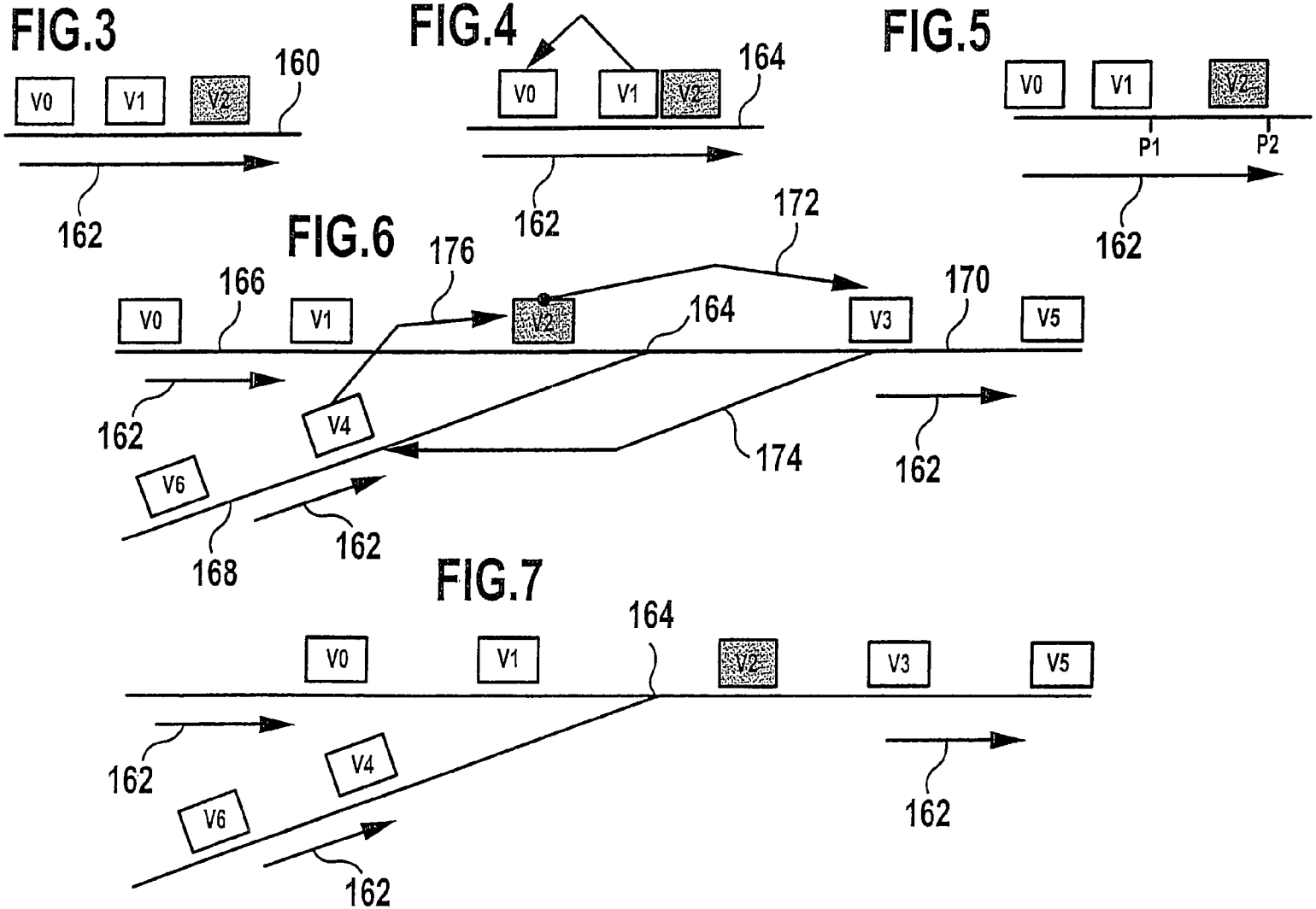
FIGS. 3 to 5 a schematic illustration of a process of communication between a vehicle and its successor in the case of a deceleration process of the forerunner.
FIGS. 6 and 7 a schematic illustration of the communication process between a vehicle and other vehicles when passing a junction point.

Three vehicles which are designated by V0, V1 and V2 and which are travelling along a track section 160 in the same direction of movement 162 are illustrated in exemplary manner in FIG. 3.

Here, the vehicle V2 is the forerunner of the vehicle V1 which, for its part, is the forerunner of the vehicle V0. The vehicle V2 does not have a current forerunner.

The vehicle V0 is the successor of the vehicle V1, which, for its part, is the successor of the vehicle V2. The vehicle V0 does not have a current successor.

Each successor continuously computes the distance to its forerunner. This can, for example, be effected directly by means of a distance measuring instrument which is arranged in the vehicle (V1 for example) and measures the distance to the vehicle travelling ahead of it (V2 for example).

As an alternative or in addition thereto, provision could also be made for the vehicle V1 to continuously determine its own position in the track network, for it to be informed continuously of the current position of the vehicle V2 by the vehicle V2 and for it then to determine the spacing between the two vehicles V2 and V1 by forming the difference between the positions of these two vehicles.

The determination of the position of a vehicle in the track network of the transport system 100 can, for example, be effected with the aid of position indicators which are arranged along the tracks of the transport system 100 and are detected by means of a detecting device in the vehicle concerned. The entire track network including all the position indicators is stored in the control unit of each vehicle 128 so that the vehicle concerned can set its current position equal to the position of the position indicator when travelling past a position indicator. The control unit of the vehicle can interpolate positions located between two position indicators succeeding one another along the track network by means of a path measuring system arranged in the vehicle which, for example, determines the distance travelled since the last position indicator on the basis of the number of revolutions of a supporting roller of the vehicle.

At the time point illustrated in FIG. 4, the vehicle V1 determines that its spacing from the forerunner V2 has become too small. As a reaction thereto, the vehicle V1 reduces its speed and conveys to its successor V0 the information that the vehicle V1 has reduced its speed.

The transmission of this information is symbolized by the arrow 164 in FIG. 4.

Due to this message from the forerunner V1, the successor V0 is informed about the deceleration of the vehicle V1 before it has determined this fact from its own measurement of the distance between the vehicles V1 and V0. In consequence, the vehicle V0 can immediately adapt its own speed to the reduced speed of the vehicle V1 travelling ahead of it in good time.

In this way, all the vehicles can be braked without jerking until they have settled into a state wherein they are at a sufficient distance from one another as at the time point illustrated in FIG. 5 whereat the vehicle V2 has reached the position P2 and the vehicle V1 has reached the position P1.

Since the track network of the transport system 100 also incorporates junction points and branching points at which the successor and forerunner relationships between the vehicles change, the information relating to the respective successor and the respective forerunner that is stored in the vehicles must be updated when passing such a node of the track network.

This process of updating the information relating to the successor and the forerunner can, for example, be effected by a direct communication process between the respective three vehicles involved.

Hereby, a first vehicle, which is approaching the junction point of two track sections, sends a message to its forerunner (second vehicle) claiming the right to pass the junction point. The second vehicle, which is on the section of track leading away from the junction point, has two successors: a respective successor on each of the track sections leading to the junction point. If this forerunner receives the message from one of its successors that this successor is claiming the right to pass the junction point, then it sends a message to the respective other successor (third vehicle) that the junction point is blocked by the first successor and simultaneously strikes the second successor from the list of its successors.

The third vehicle, which has received the message regarding the blockage of the junction point by the first vehicle from the second vehicle, stores the first vehicle as its new forerunner and sends to the first vehicle, the one which triggered the updating process, an acknowledging message to the effect that the third vehicle is now a successor of the first vehicle.

After receipt of this acknowledging message, the first vehicle stores the third vehicle as an additional successor and passes the junction point.

After passing the junction point, the first vehicle sends a message to the third vehicle that the junction point is free again.

This updating process which occurs when passing a junction point and which was described hereinabove will be explained in exemplary manner hereinafter with reference to FIGS. 6 and 7.

As can be seen from FIG. 6, two track sections 166 and 168 leading towards a junction point 164 combine at the junction point 164 into a track section 170 leading away from the junction point 164.

The direction of movement in each of the track sections is indicated by a respective arrow designated by the reference 162. The vehicles V0, V1 and V2 are moving towards the junction point 164 on the track section 166. The vehicles V3 and V5 are moving away from the junction point 164 on the track section 170. The vehicles V4 and V6 are moving towards the junction point 164 on the track section 168.

The vehicle V1 is associated with the vehicle V2 as a successor and the vehicle V3 is associated therewith as a forerunner.

The vehicles V2 and V4 are associated with the vehicle V3 as successors and the vehicle V5 is associated therewith as a forerunner.

The vehicle V6 is associated with the vehicle V4 as a successor and the vehicle V3 is associated therewith as a forerunner.

At the time point illustrated in FIG. 6, the vehicle V2 has (in dependence on the speed of the vehicle) reached a predetermined distance (brake point) from the junction point 164 and thereupon triggers an updating process by sending to its forerunner V3 a message (arrow 172) that it is entering the region of the junction point 164 and is thus blocking the junction point 164.

The vehicle V3 thereupon sends to its second successor, the vehicle V4, a message (arrow 174) that the junction point 164 is blocked and that the vehicle V2 is the new forerunner of the vehicle V4. Furthermore, the vehicle V3 deletes the vehicle V4 from the list of its successors.

The vehicle V4 replaces the vehicle V3 by the new forerunner V2 in its list of forerunners and sends to the vehicle V2 an acknowledging message (arrow 176 in FIG. 6) from which the vehicle V2 deduces that the updating process has been concluded and that the vehicle V4 is its new successor. In consequence, the vehicle V2 registers the vehicle V4 as a further successor in its list of successors.

The vehicle V2 subsequently passes the junction point 164 and thus makes the junction point 164 available again so that the state illustrated in FIG. 7 then ensues.

Now either the vehicle V1 or the vehicle V4 can trigger a new updating process in dependence on which of these vehicles is the first to drop below a predetermined distance from the junction point 164, this thereby triggering the previously described updating process.

The updating process which is triggered when a vehicle approaches a branching point of the track network of the transport system 100 is described hereinafter.

A first vehicle, which is on the section of track leading to the branching point, has two forerunners, namely, a respective forerunner on each of the sections of track leading away from the branching point.

If, (in dependence on the speed of the vehicle), the first vehicle approaching the branching point drops below a given distance from the branching point, then it sends a message to that one of its forerunners which is on the track section into which the first vehicle will not be running, said message signifying that the first vehicle is logging-off as a successor to this second vehicle and, at the same time, it informs the second vehicle who the successor of the first vehicle is.

The second vehicle thereupon strikes out the first vehicle from the list of its successors and adopts instead the thus communicated successor of the first vehicle as its new successor.

Furthermore, the second vehicle sends a message to a third vehicle, namely, to the previous successor of the first vehicle and the new successor of the second vehicle, that the second vehicle is now a further forerunner of the third vehicle.

Thereupon, the third vehicle, which is travelling behind the first vehicle on the section of track leading to the branching point, enters the second vehicle as an additional forerunner in its list of forerunners.

Furthermore, the third vehicle sends an acknowledgement message to the first vehicle, from which the first vehicle deduces that the updating process has been concluded.

The first vehicle then passes the branching point and a new updating process is started as soon as the third vehicle that was following it drops below the given distance from the branching point.

This updating process is explained hereinafter with reference to FIGS. 8 and 9.

Figure 8:
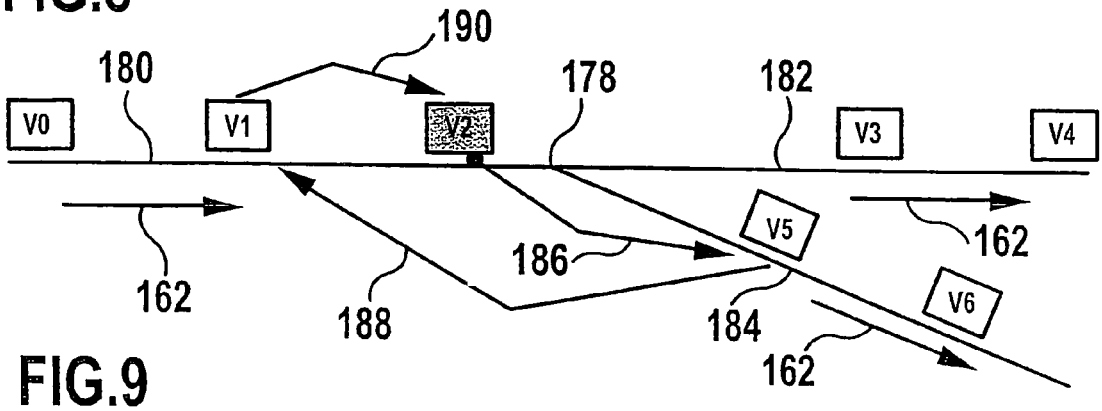
FIGS. 8 and 9 a schematic illustration of the communication process between a vehicle and other vehicles when passing a branching point.
Figure 9:
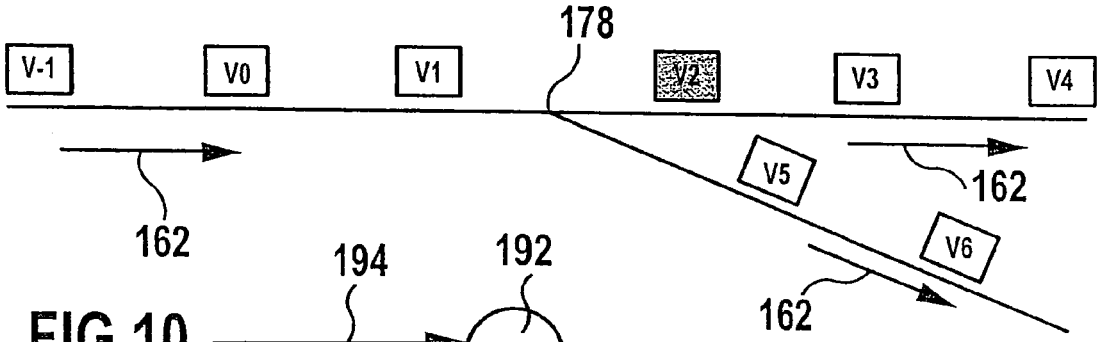

In the situation illustrated in FIG. 8, the vehicles V2, V1 and V0 are travelling towards the branching point 178 on the track section 180 leading to the branching point 178 in the direction of movement 162, whereas the vehicles V3 and V4 are travelling away from the branching point 178 on a first track section 182 that leads away from the branching point 178 and the vehicles V5 and V6 are travelling away from the branching point 178 on a second track section 184 that leads away from the branching point 178.

The vehicle V0 is associated with the vehicle V1 as a successor and the vehicle V2 is associated therewith as a forerunner.

The vehicle V1 is associated with the vehicle V2 as a successor and the vehicles V3 and V5 are associated therewith as forerunners.

The vehicle V2 is associated with the vehicle V3 as a successor and the vehicle V4 is associated therewith as a forerunner.

The vehicle V2 is associated with the vehicle V5 as a successor and the vehicle V6 is associated therewith as a forerunner.

At the time point illustrated in FIG. 8, the vehicle V2 drops below a minimum distance from the branching point 178 (in dependence on the speed of the vehicle), this thereby triggering an updating process.

This updating process involves the vehicle V2 initially sending a message (arrow 186) to the vehicle V5 to the effect that the vehicle V2 is logging-off as a successor to the vehicle V5 whilst simultaneously informing it that the former successor of the vehicle V2 is now the new successor of the vehicle V5.

The vehicle V5 thereupon replaces its former successor V2 by the new successor V1 in the list of its successors.

Subsequently, the vehicle V5 sends a message (arrow 188) to the vehicle V1 for the purposes of informing it that the vehicle V5 is a new, additional forerunner of the vehicle V1.

The vehicle V1 thereupon enters the vehicle V5 as an additional forerunner in its list of forerunners.

Furthermore, the vehicle V1 sends an acknowledging message (arrow 190) to the vehicle V2, and the vehicle V2 deduces therefrom that the updating process has been successfully concluded.

The vehicle V2 then passes the branching point 178 (see FIG. 9) and a new updating process, which is triggered by the vehicle V1, begins as soon as the vehicle V1 drops below the given minimum distance from the branching point 178.

In the previously described junction type and branching type processes, the successor and forerunner relationships between the vehicles were updated when passing the respective node exclusively by a process of communication between the vehicles themselves. As an alternative or in addition thereto, provision could also be made for the updating of the successor and forerunner relationships when passing a node to be effected with the help of a node administration unit assigned to the respective node.

Such a node administration unit, which comprises a programmable computer and the appertaining node administration software, can be arranged outside the vehicles, and in particular, in a fixed node administration computer.

However, as an alternative or in addition thereto, it is also possible for the node administration unit to be in the form of a component of the control unit of one of the vehicles.

An updating process occurring when passing a junction point can be effected by drawing upon the node administration unit for the junction point as follows:

When passing a so-called brake point which is spaced from the junction point by a given distance that is dependent on the speed of the vehicle, a vehicle moving towards this junction point sends a message to the node administration unit indicating that the vehicle is entering the region covered by the junction point associated with the node administration unit.

The node administration unit keeps a list of the vehicles which have previously entered the region covered by the junction point.

If this list is empty, then the node administration unit only sends an acknowledging message to the approaching vehicle, and the forerunner and successor relationships of the vehicle remain unchanged.

If, however, a vehicle is registered in this node administration unit's list, then the node administration unit sends a message to the vehicle registered in the list that this second vehicle should adopt the first vehicle as a so-called "next successor".

In this embodiment of the invention, two successors are associated with each vehicle, namely, a "current successor" and a "next successor".

In corresponding manner, two forerunners are also associated with each vehicle, namely, a "current forerunner" and a "next forerunner".

The second vehicle thus registers the first vehicle as its "next successor" and sends an acknowledgement message to the first vehicle, from which the first vehicle deduces that the second vehicle is now its "next forerunner". In corresponding manner, the first vehicle registers the second vehicle as its "next forerunner".

The first updating process that was triggered by the first vehicle when passing the brake point is thereby concluded.

A second updating process is triggered by the first vehicle when it reaches a so-called "collision point" located prior to the junction point. The distance of the collision point from the junction point is specified (independently of speed) in such a way that a vehicle located prior to the collision point cannot collide with another vehicle travelling on another track section towards the selfsame junction point.

If the vehicle does not have a current successor when reaching the collision point, then the vehicle sends a message to the node administration unit, the node administration unit deducing therefrom that the vehicle concerned will be travelling via the junction point into the track section leading away from the junction point.

Thereupon, the node administration unit sends an acknowledgement message to the vehicle concerned, the vehicle deducing from this message that the node administration unit has registered its passage through the junction point, said acknowledgement message also causing the vehicle to make its next successor, should there be one, into its current successor.

If the vehicle does have a current successor when reaching the collision point, then this first vehicle sends a message to this current successor, i.e. a second vehicle, said message causing the second vehicle to strike out the first vehicle as its current forerunner and to make its "next forerunner" into its "current forerunner" instead.

If, at this time point, there is no next forerunner associated with the second vehicle, then only the current forerunner is deleted.

Furthermore, the second vehicle sends a message to the node administration unit by means of which the node administration unit is informed that the first vehicle is passing the junction point.

The node administration unit thereupon sends an acknowledging message to the first vehicle, which thus leads to the first vehicle striking out its current successor and, should there be one, making its next successor into its new current successor.

The second updating process that was triggered by the act of reaching the collision point is thereby concluded.

The previously described procedure when passing a junction point will be explained hereinafter by means of examples taken with reference to FIGS. 10 to 16.

Figure 10:
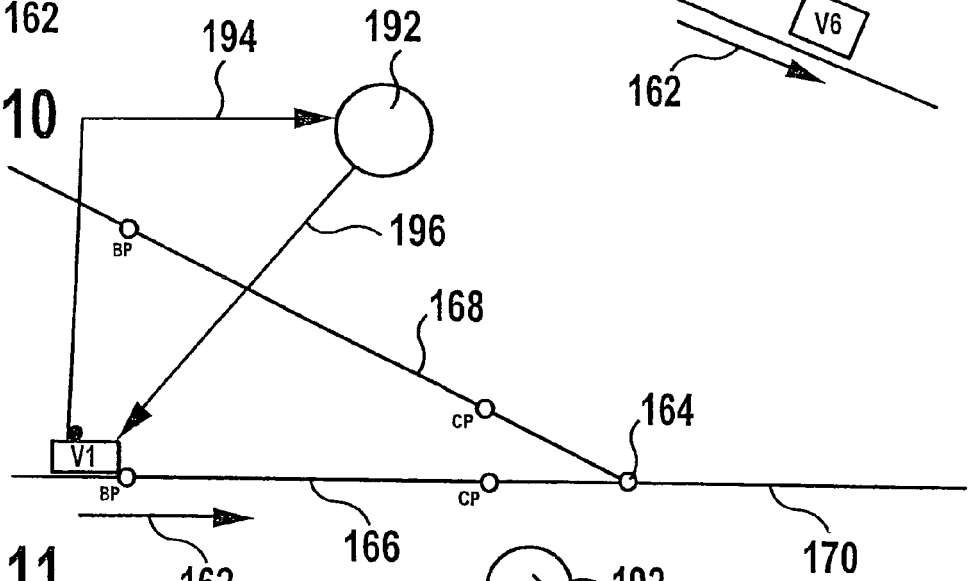
FIGS. 10 and 11 a schematic illustration of the communication process between a vehicle and a node administration unit when passing a junction point.

In FIG. 10, the vehicle V1 is moving towards the junction point 164 on the track section 166.

No current successor is associated with the vehicle V1. The forerunner list in the node administration unit 192 assigned to the junction point 164 is empty.

Upon reaching the brake point (BP), the vehicle V1 sends a message (arrow 194) to the node administration unit 192 by means of which the vehicle V1 announces its presence to the node administration unit 192.

The node administration unit 192 sends an acknowledging message (arrow 196) back to the vehicle V1.

Figure 11:
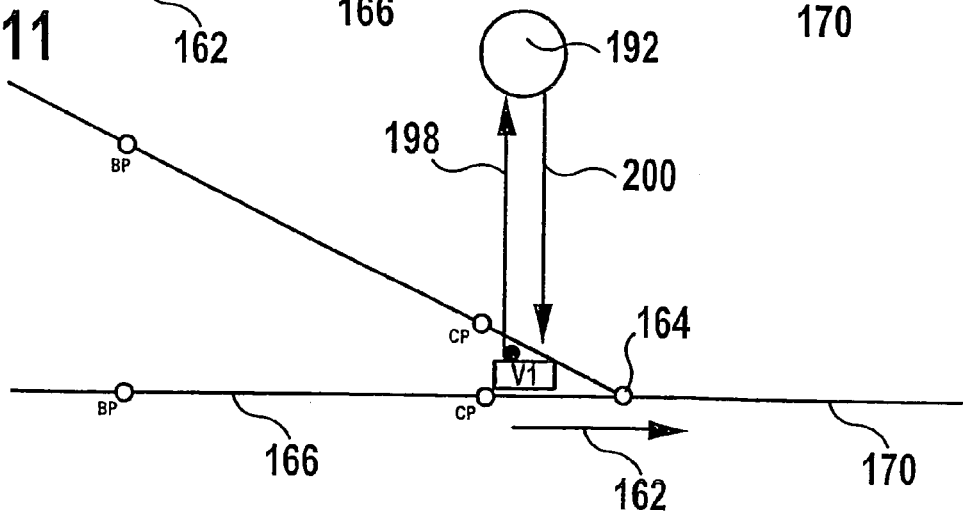

Upon reaching the collision point (CP), the vehicle V1 sends a message (arrow 198) to the node administration unit 192 by means of which an indication is given to the node administration unit 192 of the passing of the junction point 164 by the vehicle V1 (FIG. 11).

The node administration unit 192 sends an acknowledging message (arrow 200) to the vehicle V1.

The vehicle V1 subsequently changes from the track section 166 via the junction point 164 to the track section 170 leading away from the junction point 164. A change of successor or forerunner relationships of the vehicle V1 has not taken place.

Figure 12:
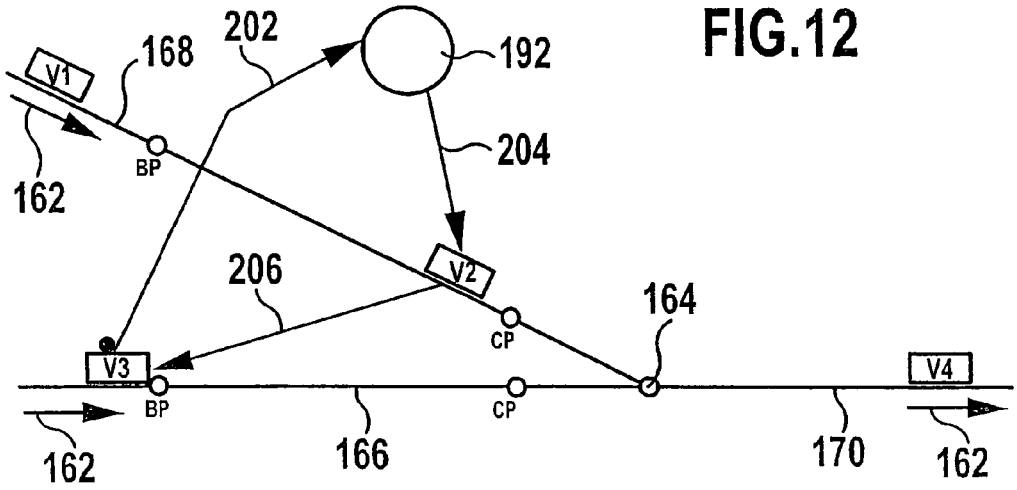
FIGS. 12 and 13 a schematic illustration of the communication process between vehicles and a node administration unit and between themselves when passing a brake point and a collision point which are associated with a junction point.

In the situation illustrated in FIG. 12, the vehicles V1 and V2 are moving towards the junction point 164 on the track section 168. The vehicle V3 is moving towards the junction point 164 on the track section 166. The vehicle V4 is moving away from the junction point 164 on the track section 170.

The vehicle V1 is associated with the vehicle V2 as the current successor. The vehicle V2 does not possess a next successor.

Neither a current forerunner nor a next forerunner are associated with the vehicle V3.

The vehicle V2 is associated with the vehicle V1 as the current forerunner. The vehicle V1 does not possess a next forerunner.

The vehicle V2 is registered in the forerunner list of the node administration unit 192, this vehicle being the last one to have indicated its presence to the node administration unit 192 when passing the brake point in the track section 168.

Upon reaching the brake point (BP) in the track section 166, the vehicle V3 sends a message (arrow 202) for the purposes of indicating the presence of the vehicle V3 to the node administration unit 192 (FIG. 12).

The node administration unit 192 thereupon sends a message (arrow 204) to the vehicle V2 for indicating thereto that the vehicle V3 is now the next successor to the vehicle V2.

The vehicle V2 registers the vehicle V3 as its next successor and sends an acknowledging message (arrow 206)

to the vehicle V3 which leads to the vehicle V3 registering the vehicle V2 as its next forerunner.

The updating process that was triggered by the vehicle V3 upon passing the brake point is thereby concluded.

Figure 13:
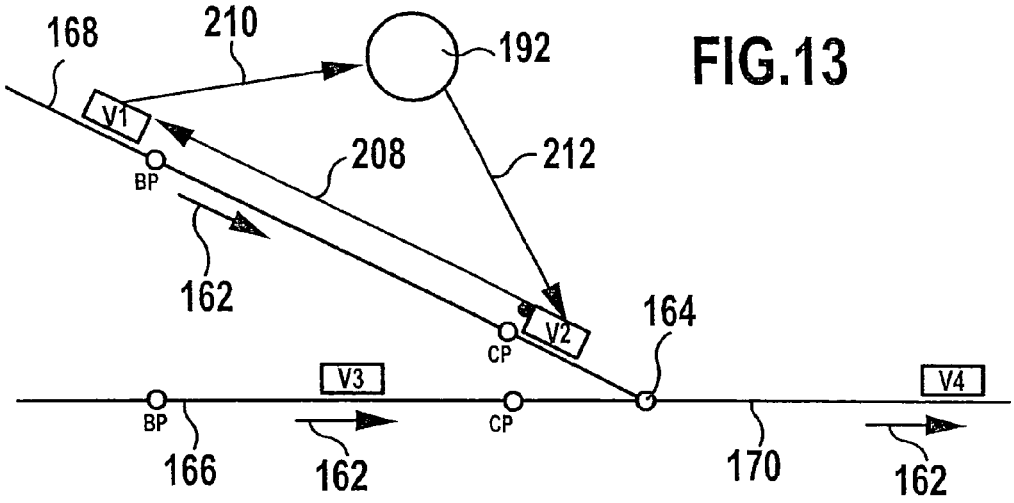

At the time point illustrated in FIG. 13, the vehicle V2 reaches the collision point (CP) and in consequence sends a message (arrow 208) to its current successor, the vehicle V1, this message causing the vehicle V1 to strike the vehicle V2 as its current forerunner and replace it by the next forerunner. However, as there is no next forerunner associated with the vehicle V1, the vehicle V1 does not receive a new current forerunner.

Furthermore, the vehicle V1 sends a message (arrow 210) to the node administration unit 192 for informing the node administration unit 192 that the vehicle V2 is now changing to the track section 170.

The node administration unit 192 sends an acknowledging message (arrow 212) to the vehicle V2 which thereupon strikes the vehicle V1 as its current successor and registers the vehicle V3 as its current successor rather than its next successor and strikes the vehicle V3 as its next successor.

The updating process that was triggered by the vehicle V2 upon reaching the collision point is thereby concluded.

Figure 14:
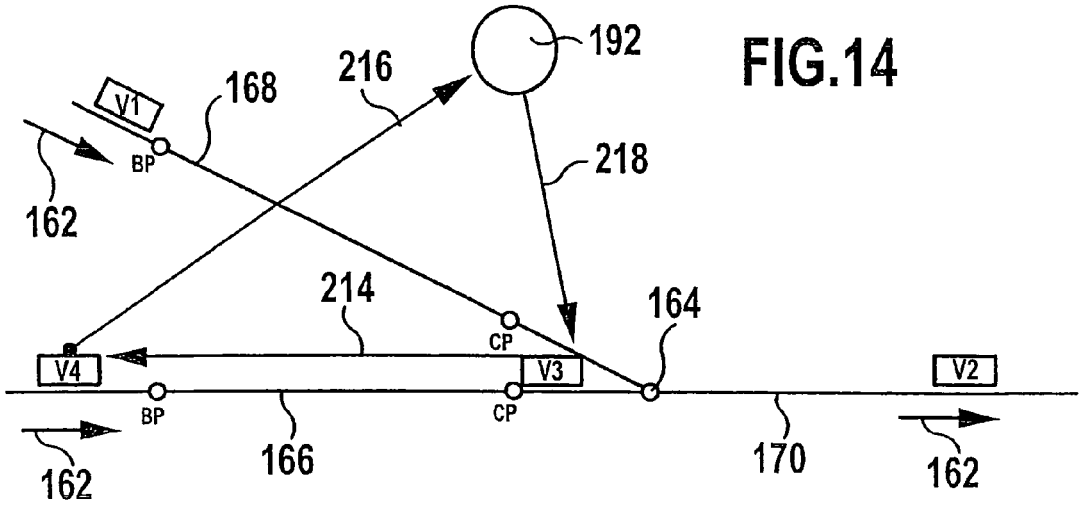

In the situation illustrated in FIG. 14, the vehicle V1 is moving towards the junction point 164 on the track section 168. The vehicles V3 and V4 are moving towards the junction point 164 on the track section 166. The vehicle V2 is moving away from the junction point 164 on the track section 170.

The vehicle V4 is associated with the vehicle V3 as the current successor. A next successor is not associated with the vehicle V3. The vehicle V2 is associated with the vehicle V3 as the current forerunner. A next forerunner is not associated with the vehicle V3.

The vehicle V3 is associated with the vehicle V4 as the current forerunner. A next forerunner is not associated with the vehicle V4.

In the situation illustrated in FIG. 14, the vehicle V3 reaches the collision point in the track section 166 and thereupon sends a message (arrow 214) to the vehicle V4, its current successor, which causes the vehicle V4 to strike out the vehicle V3 as its current forerunner. Since the vehicle V4 does not have a next forerunner, it does not receive a new current forerunner.

The vehicle V4 sends a message (arrow 216) to the node administration unit 192 for indicating to the node administration unit 192 that the vehicle V3 is now passing the junction point 164.

The node administration unit 192 sends an acknowledging message (arrow 218) to the vehicle V3 which causes the vehicle V3 to strike out the vehicle V4 as its current successor. Since the vehicle V3 does not have a next successor, it does not receive a new current successor.

A short time later, as is illustrated in FIG. 15, the vehicle V4 reaches the brake point (BP) and thereupon sends a message (arrow 220) to the node administration unit 192 for informing it that the vehicle V4 intends to pass the junction point 164.

The vehicle V3 is registered in the forerunner list of the node administration unit 192.

The node administration unit 192 therefore sends a message (arrow 222) to the vehicle V3, said message indicating that the vehicle V4 is now a new next successor to the vehicle V3.

The vehicle V3 registers the vehicle V4 as its new next successor and sends an acknowledging message to this effect (arrow 224) to the vehicle V4 which thereupon registers the vehicle V3 as its next forerunner.

The updating process that was triggered by the vehicle V4 upon reaching the brake point is thereby concluded.

In the case of a variant of the situation shown in FIG. 15 which is illustrated in FIG. 16, the vehicle V4 reaches the brake point before the vehicle V3 has reached the collision point.

Consequently, in the situation illustrated in FIG. 16, the vehicle V3 is registered as the current forerunner of the vehicle V4 and the vehicle V4 is registered as the current successor of the vehicle V3.

Upon reaching the brake point, the vehicle V4 sends a message (arrow 226) to the node administration unit 192 for informing it that the vehicle V4 wishes to pass through the junction point 164.

The vehicle V3 is registered in the forerunner list of the node administration unit 192 and, for this reason, the node administration unit 192 sends a message (arrow 228) to the vehicle V3 by means of which the vehicle V4 is indicated as being a new next successor to the vehicle V3.

The vehicle V3 registers the vehicle V4 as its next successor and sends an acknowledging message (arrow 230) to the vehicle V4 which causes the vehicle V4 to register the vehicle V3 as its new next forerunner.

The updating process that was triggered by the vehicle V4 upon reaching the brake point is thereby concluded.

The updating processes involving the inclusion of a node administration unit when passing a branching point of the track network of the transport system 100 correspond to the updating processes that occur when passing a junction point but with the difference that, in the case of a branching point, the collision points (CP) are not located prior to the node in the direction of movement, but rather, are located beyond the node in the direction of movement, i.e. beyond the branching point, that the node administration unit maintains its own forerunner list for each of the track sections leading away from the branching point and that, when the vehicles are announcing their intention of passing the branching point 178 to the node administration unit 192, they simultaneously indicate the particular track sections leading away from the branching point 178 upon which they want to travel.

Thus, when a vehicle reaches the brake point prior to the branching point, it then sends a message to the administration unit assigned to the node for informing it that the vehicle intends to pass the branching point and for indicating that one of the onwardly extending track sections over which it intends to continue its journey.

If there is no forerunner entered in the forerunner list of the node administration unit for the track section concerned, the node administration unit sends an acknowledgement message back to the vehicle concerned.

If a vehicle is contained in the forerunner list of the node administration unit for the desired track section, then the node administration unit sends a message to this second vehicle which results in this second vehicle registering the first vehicle as its next successor and sending an acknowledgement message to the first vehicle for causing the first vehicle to register the second vehicle as its next forerunner.

In the event that the second vehicle does not have a current successor, the first vehicle is registered as being the current successor of the second vehicle and struck out as the next successor of the second vehicle.

In the event that the first vehicle does not have a current forerunner, the second vehicle is registered as the current forerunner of the first vehicle and struck out as the next forerunner of the first vehicle.

The updating process that was triggered by the first vehicle upon reaching the brake point is thereby concluded.

When the vehicle reaches the collision point (CP) on its new track section after passing the branching point, then this first vehicle sends a message to its current successor which causes this second vehicle to strike out the first vehicle as its current forerunner and, should there be one, to make its next forerunner its current forerunner.

Furthermore, the second vehicle sends a message to the node administration unit by means of which the node administration unit is informed that the first vehicle has passed the branching point.

The node administration unit thereupon sends an acknowledging message to the first vehicle which causes the first vehicle to strike out the second vehicle as its current successor and, should there be one, to make its next successor into its current successor.

The updating process that was triggered by the first vehicle upon reaching the collision point is thereby concluded.

If, upon reaching the collision point, no current successor is associated with the vehicle, then the vehicle concerned sends a message to the node administration unit by means of which the node administration unit is informed that the vehicle concerned has passed the branching point.

The node administration unit sends an acknowledging message to the vehicle concerned which then causes this vehicle to make its next successor, should there be one, into its current successor.

The updating process that was triggered by the vehicle upon reaching the collision point is thereby concluded.

The updating processes occurring when passing a branching point 178 will be explained hereinafter with reference to FIGS. 17 to 26.

In the situation illustrated in FIG. 17, the vehicle V6 is moving towards the branching point 178 on the track section 180, whilst the vehicle V7 is moving away from the branching point 178 on the track section 182.

At the time point illustrated in FIG. 17, the vehicle V6 reaches the brake point (BP) in the track section 180 and thereupon sends a message (arrow 232) to the node administration unit 192 responsible for the branching point 178 by means of which the node administration unit 192 is informed that the vehicle V6 would like to pass the branching point 178 and change onto the track section 184.

Since the vehicle V7 is present on the other track section 182 and hence the forerunner list of the node administration unit 192 is empty for the track section 184, the node administration unit 192 sends an acknowledging message (arrow 234) directly to the vehicle V6.

At the time point illustrated in FIG. 18, the vehicle V6 has passed the branching point 178, has changed onto the track section 184 and has gone past the collision point (CP) there.

Since, at this time point, the vehicle V6 does not have a current successor, it sends a message (arrow 236) to the node administration unit 192 by means of which an indication is given to the node administration unit 192 that the vehicle V6 has left the region of the branching point 178.

The node administration unit 192 sends an acknowledging message (arrow 238) to the vehicle V6 which causes the vehicle V6 to make its next successor, should there be one, the current successor.

The updating process that was triggered by the vehicle V6 upon passing the collision point is thereby concluded.

Figure 19:
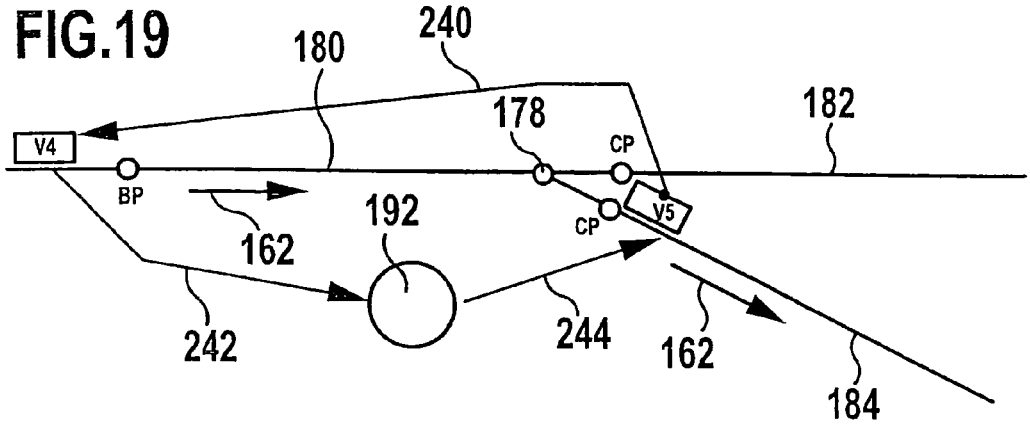
FIG. 19 a schematic illustration of the intercommunication process between vehicles and the communication process with a node administration unit when passing a collision point relating to a branching point.

In the situation illustrated in FIG. 19, the vehicle V4 is moving towards the branching point 178 on the track section 180, whilst the vehicle V5 is moving away from the branching point 178 on the track section 184.

The vehicle V5 is associated with the vehicle V4 as the current forerunner. The vehicle V4 is associated with the vehicle V5 as the current successor.

At the time point illustrated in FIG. 19, the vehicle V5 has gone past the collision point (CP) in the track section 184 and therefore sends a message (arrow 240) to its current successor, the vehicle V4, which message causes the vehicle V4 to strike out the vehicle V5 as its current forerunner and to register its next forerunner as its current forerunner. However, as no next forerunner is associated with the vehicle V4, it does not receive a new current forerunner.

The vehicle V4 sends a message (arrow 242) to the node administration unit 192 by means of which the node administration unit 192 is informed that the vehicle V5 has left the region of the branching point 178.

The node administration unit 192 sends an acknowledging message (arrow 244) to the vehicle V5 which causes the vehicle V5 to strike out the vehicle V4 as its current successor and, should there be one, to register its next successor as its current successor. However, as no next successor is associated with the vehicle V5, the vehicle V5 does not receive a new current successor.

The updating process that was triggered by the vehicle V5 upon passing the collision point is thereby concluded.

Figure 20:
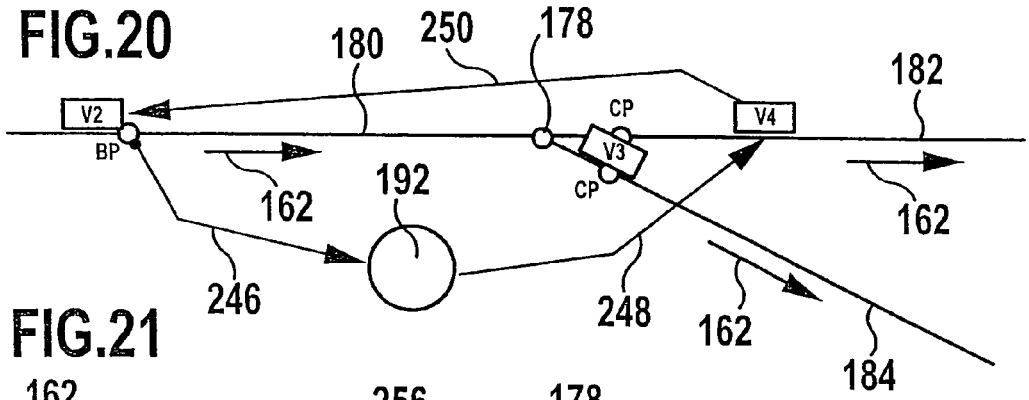
FIGS. 20 to 26 a schematic illustration of the communication process between vehicles and a node administration unit and between themselves, wherein a plurality of vehicles are passing the brake points and the collision points of a branching point one behind the other.

In the situation illustrated in FIG. 20, the vehicle V2 is moving towards the branching point 178 on the track section 180, whilst the vehicle V4 is moving away from the branching point 178 on the track section 182 and the vehicle V3 is moving away from the branching point 178 on the track section 184.

The vehicle V3 is associated with the vehicle V2 as the current forerunner, but there is no vehicle associated therewith as the next forerunner. Furthermore, an (as yet not illustrated in FIG. 20) vehicle V1 is associated with the vehicle V2 as the current successor thereof, although no vehicle is associated therewith as the next successor.

The vehicle V2 is associated with the vehicle V3 as the current successor, although no vehicle is associated therewith as the next successor.

Neither a current successor nor a next successor are associated with the vehicle V4.

At the time point illustrated in FIG. 20, the vehicle V2 reaches the brake point in the track section 180 and thereupon sends a message (arrow 246) to the node administration unit 192 for informing it that the vehicle V2 intends to pass the branching point 178 and continue its journey on the track section 182.

Since the vehicle V4 is registered in the forerunner list of the node administration unit 192 for the track section 182, the node administration unit 192 sends a message (arrow 248) to the vehicle V4 which causes the vehicle V4 to register the vehicle V2 as its next successor.

Since the vehicle V4 does not have a current successor, the vehicle V2 is registered as the current successor of the vehicle V4 and struck out as the next successor of the vehicle V4.

The vehicle V4 sends an acknowledging message (arrow 250) to the vehicle V2 which causes the vehicle V2 to register the vehicle V4 as its next forerunner.

The updating process that was triggered by the vehicle V2 upon reaching the brake point is thereby concluded.

Figure 21:
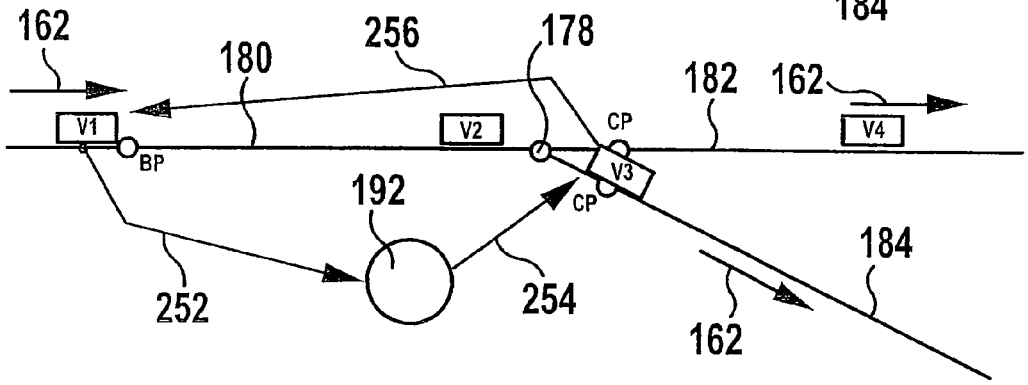

At the time point illustrated in FIG. 21, the vehicle V1 following the vehicle V2 on the track section 180 reaches the brake point in the track section 180.

The vehicle V2 is associated with the vehicle V1 as the current forerunner.

Upon reaching the brake point, the vehicle V1 sends a message (arrow 252) to the node administration unit 192 for informing it that the vehicle V1 intends to pass the branching point 178 and continue its journey on the track section 184.

Since the vehicle V3 is registered in the forerunner list of the node administration unit 192 for the track section 184, the node administration unit 192 sends a message (arrow 254) to the vehicle V3 which causes the vehicle V3 to register the vehicle V1 as its next successor.

Furthermore, the vehicle V3 sends an acknowledging message (arrow 256) to the vehicle V1 which causes the vehicle V1 to register the vehicle V3 as its next forerunner.

The updating process that was triggered by the vehicle V1 upon reaching the brake point is thereby concluded.

Figure 22:
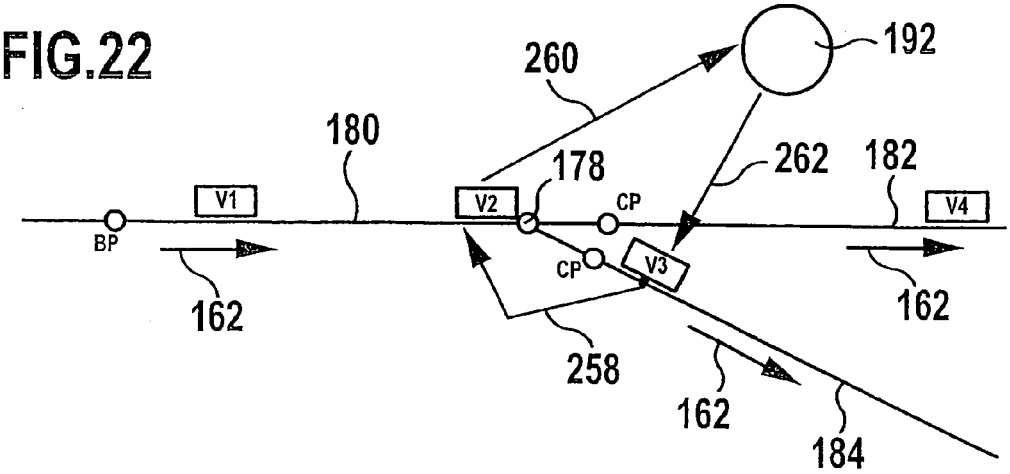

At the time point illustrated in FIG. 22, the vehicle V3 has gone past the collision point (CP) on the track section 184 and, for this reason, the vehicle V3 sends a message (arrow 258) to its current successor, the vehicle V2, which causes the vehicle V2 to strike out the vehicle V3 as its current forerunner and to register its next forerunner, the vehicle V4, as its current forerunner, whereby the vehicle V4 is simultaneously struck out as the next forerunner of the vehicle V2.

Furthermore, the vehicle V2 sends a message (arrow 260) to the node administration unit 192 which indicates to the node administration unit 192 that the vehicle V3 has left the region of the branching point.

The node administration unit 192 sends an acknowledging message (arrow 262) to the vehicle V3 which causes the vehicle V3 to strike out the vehicle V2 as its current successor and to register its next successor, the vehicle V1, as its current successor, whereby the vehicle V1 is simultaneously struck out as the next successor.

The updating process that was triggered by the vehicle V3 upon passing the collision point is thereby concluded.

Figure 23:
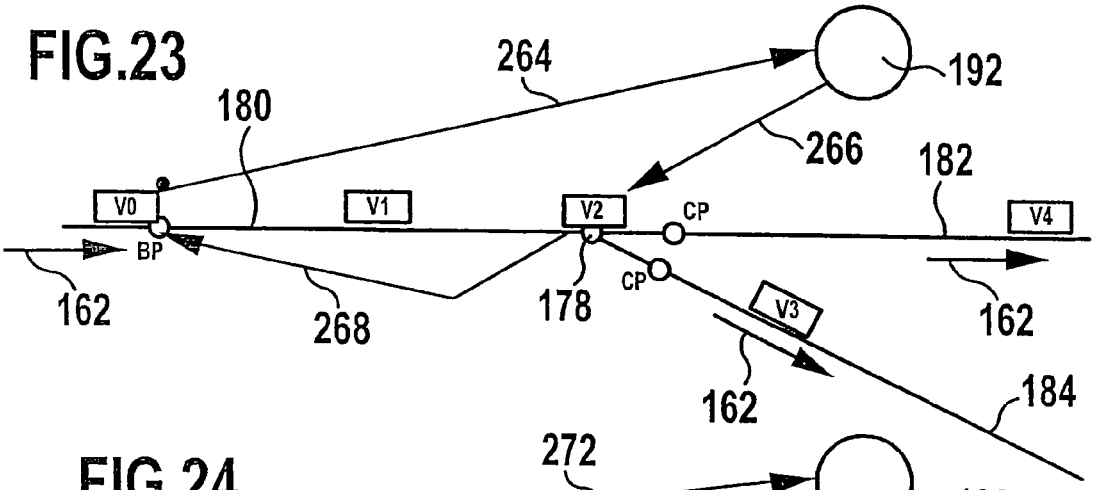

At the time point illustrated in FIG. 23, a further vehicle V0, which is moving behind the vehicle V1 on the track section 180, reaches the brake point on the track section 180.

The vehicle V1 is associated with the vehicle V0 as the current forerunner. Upon reaching the brake point, the vehicle V0 sends a message (arrow 264) to the node administration unit 192 by means of which the vehicle V0 announces its intention of passing the branching point 178 and continuing its journey on the track section 182.

Since the vehicle V2 is registered in the forerunner list of the node administration unit 192 for the track section 182, the node administration unit 192 sends a message (arrow 266) to the vehicle V2 which causes the vehicle V2 to register the vehicle V0 as its next successor.

Furthermore, the vehicle V2 sends an acknowledging message (arrow 268) to the vehicle V0 which causes the vehicle V0 to register the vehicle V2 as its next forerunner.

The updating process that was triggered by the vehicle V0 upon reaching the brake point is thereby concluded.

Figure 24:
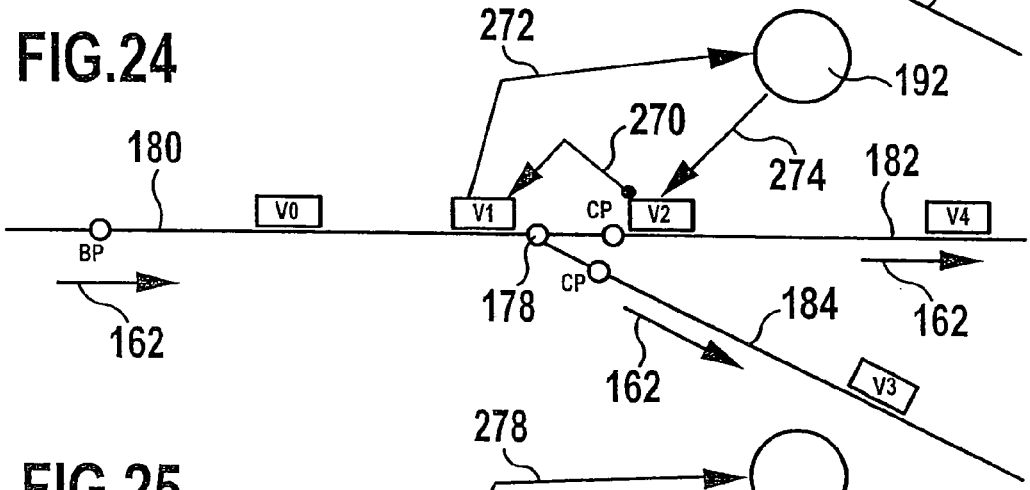

At the time point illustrated in FIG. 24, the vehicle V2 has passed the collision point (CP) on the track section 182.

Consequently, the vehicle V2 sends a message (arrow 270) to its current successor, the vehicle V1, which causes the vehicle V1 to strike out the vehicle V2 as its current forerunner and to register its next forerunner, the vehicle V3, as its current forerunner, whereby the vehicle V3 is simultaneously struck out as the next forerunner of the vehicle V1.

Furthermore, the vehicle V1 sends a message (arrow 272) to the node administration unit 192 by means of which the node administration unit 192 is informed that the vehicle V2 has left the region of the branching point.

The node administration unit 192 sends an acknowledging message (arrow 274) to the vehicle V2 which causes the vehicle V2 to strike out the vehicle V1 as its current successor and to register instead, its next successor, the vehicle V0, as its current successor, whereby the vehicle V0 is simultaneously struck out as the next successor of the vehicle V2.

The updating process that was triggered by the vehicle V2 after it had passed the collision point is thereby concluded.

Figure 25:
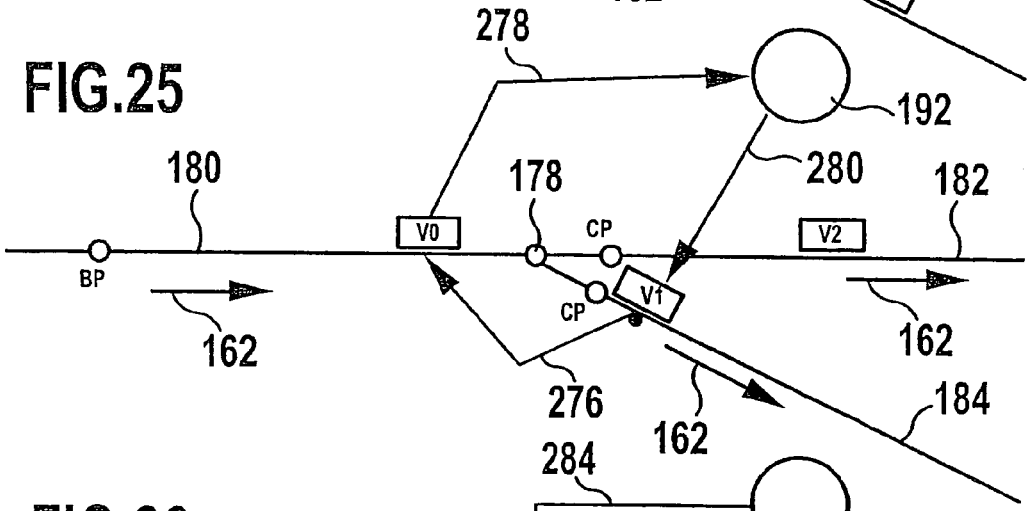

At the time point illustrated in FIG. 25, the vehicle V1 has gone past the collision point (CP) on the track section 184.

Consequently, the vehicle V1 sends a message (arrow 276) to its current successor, the vehicle V0, which causes the vehicle V0 to strike out the vehicle V1 as its current forerunner and to register instead, its next forerunner, the vehicle V2, as its current forerunner, whereby the vehicle V2 is simultaneously struck out as the next forerunner of the vehicle V0.

Furthermore, the vehicle V0 sends a message (arrow 278) to the node administration unit 192 by means of which the node administration unit 192 is informed that the vehicle V1 has left the region of the branching point.

The node administration unit 192 sends an acknowledging message (arrow 280) to the vehicle V1 which causes the vehicle V1 to strike out the vehicle V0 as its current successor and to register its next successor as the new current successor. However, as no next successor is associated with the vehicle V1, the vehicle V1 does not receive a new current successor.

The updating process that was triggered by the vehicle V1 after it had passed the collision point is thereby concluded.

Figure 26:
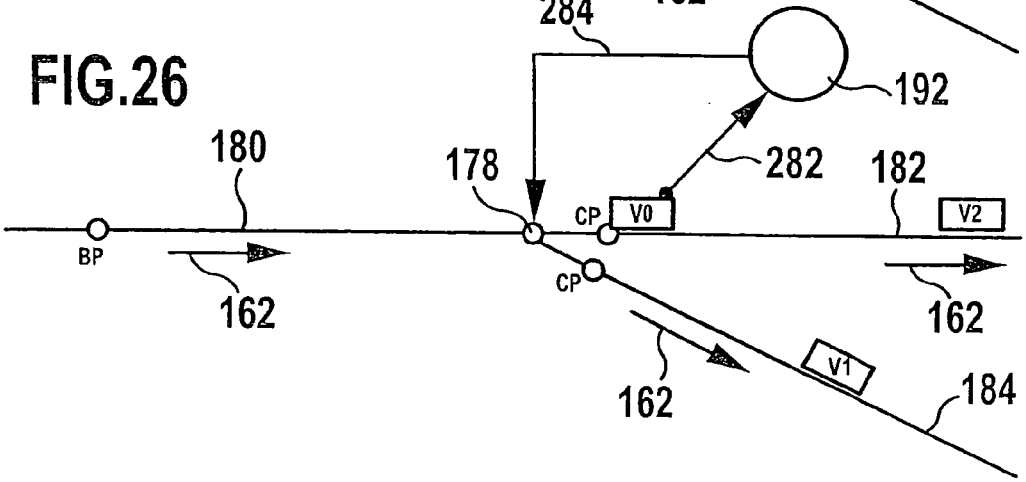

At the time point illustrated in FIG. 26, the vehicle V0 has gone past the collision point (CP) on the track section 182.

No current successor is associated with the vehicle V0 and, for this reason, the vehicle V0 sends a message (arrow 282) directly to the node administration unit 192 for informing the node administration unit 192 that the vehicle V0 has left the region of the branching point.

The node administration unit 192 sends an acknowledging message (arrow 284) to the vehicle V0 which causes the vehicle V0 to strike out its current successor and to register its next successor as a new current successor, whereby the next successor is simultaneously struck out.

However, as neither a current successor nor a next successor are associated with the vehicle V0, the successor relationships of the vehicle V0 remain unchanged.

The updating process that was triggered by the vehicle V0 after it had passed the collision point is thereby concluded.

The junction points 164 and the branching points 178 of the track network of the transport system 100 are implemented by means of so-called "active points", whereby an "active point" is to be understood as being a point having movable rail sections, in contrast to a "passive point" wherein all the rail sections are stationary and the rail section to be used by a vehicle is selected by operating a guidance device located in the vehicle. An active point for a suspended monorail system is known from DE 33 02 266 C2 for example.

The invention claimed is:

1. A method of controlling the vehicles of a track-guided transport system, and in particular of a suspended monorail system, which comprises:

providing a track network incorporating at least one node at which at least two track sections of the track network adjoin one another;

providing a plurality of vehicles travelling along the track network, each vehicle comprising a control unit;

associating with each vehicle information about at least one successor or the information that the vehicle does not have a successor, and/or information about at least one forerunner or the information that the vehicle does not have a forerunner;

storing the information relating to the successor or the forerunner in the control unit of the vehicle; and updating the information relating to the successor or the forerunner each time when the respective vehicle passes a node of the track network.

2. A method in accordance with claim 1, wherein the information relating to a successor and/or a forerunner is updated when the vehicle passes a node of the track network which is in the form of a branching point at which one track branches out into a plurality of onwardly extending tracks.

3. A method in accordance with claim 1, wherein the information relating to a successor and/or a forerunner is updated when the vehicle passes a node of the track network which is in the form of a junction point at which a plurality of tracks combine into one onwardly extending track.

4. A method in accordance with claim 1, wherein the information relating to a successor and/or a forerunner of a vehicle is updated by a process of communication between the vehicle and at least one other vehicle.

5. A method in accordance with claim 1, wherein the information relating to a successor and/or a forerunner of a vehicle is updated by a process of communication between the vehicle and a node administration unit arranged outside the vehicle.

6. A method in accordance with claim 5, wherein at least one node administration unit is stationary.

7. A method in accordance with claim 5, wherein at least one node administration unit is arranged in a central control unit of the transport system.

8. A method in accordance with claim 5, wherein at least one node administration unit administers a plurality of nodes of the track network.

9. A method in accordance with claim 5, wherein a separate node administration unit is associated with each node of the track network.

10. A method in accordance with claim 1, wherein, after passing a brake point which is associated with a node, a vehicle sends a message which is effective to update the information relating to a successor and/or a forerunner of the vehicle concerned.

11. A method in accordance with claim 1, wherein, after passing a brake point which is associated with a node, a vehicle sends a message which is effective to update the information relating to a successor and/or a forerunner of at least one other vehicle.

12. A method in accordance with claim 1, wherein, after passing a brake point which is associated with a node, a vehicle sends a message which is effective to update the information relating to a successor and/or a forerunner of at least one vehicle, and subsequently receives an acknowledging message which was triggered directly or indirectly by the sending of the message.

13. A method in accordance with claim 1, wherein, after passing a collision point which is associated with a node, a vehicle sends a message which is effective to update the information relating to a successor and/or a forerunner of the vehicle concerned.

14. A method in accordance with claim 1, wherein, after passing a collision point which is associated with a node, a vehicle sends a message which is effective to update the information relating to a successor and/or a forerunner of another vehicle.

15. A method in accordance with claim 1, wherein, after passing a collision point which is associated with a node, a vehicle sends a message which is effective to update the information relating to a successor and/or a forerunner of at least one vehicle, and subsequently receives an acknowledging message which was triggered directly or indirectly by the sending of the message.

16. A method of controlling the vehicles of a track-guided transport system, and in particular of a suspended monorail system, which comprises:

providing a track network incorporating at least one node at which at least two track sections of the track network adjoin one another;

providing a plurality of vehicles travelling along the track network, each vehicle comprising a control unit;

associating with each vehicle information about at least one successor or the information that the vehicle does not have a successor, and/or information about at least one forerunner or the information that the vehicle does not have a forerunner;

storing the information relating to the successor or the forerunner in the control unit of the vehicle;

and updating the information relating to the successor or the forerunner when the vehicle passes a node of the track network;

wherein the information relating to the successor is contained in a list of successors and the information relating to the forerunner is contained in a list of forerunners, and the list of successors and/or the list of forerunners is updated when the vehicle passes a node of the track network.

* * * * *